United States Patent [19]

Coll

[11] Patent Number: 5,058,282

[45] Date of Patent: Oct. 22, 1991

[54] ELLIPSOGRAPH

[76] Inventor: Albert G. Coll, Rte. 3, Box 3724 Adam West Rd., Morrison, Tenn. 37357

[21] Appl. No.: 681,749

[22] Filed: Apr. 8, 1991

[51] Int. Cl.[5] ..... B43L 11/04

[52] U.S. Cl. ..... 33/31

[58] Field of Search ..... 33/30 R, 31

[56] References Cited

U.S. PATENT DOCUMENTS

| | | | |
|---|---|---|---|
| 932,768 | 8/1909 | Dexter | 33/31 |
| 1,031,780 | 7/1912 | Fine | 33/31 |
| 2,326,412 | 8/1943 | Taylor | 33/31 |

FOREIGN PATENT DOCUMENTS

| | | | |
|---|---|---|---|
| 170206 | 10/1921 | United Kingdom | 33/31 |

*Primary Examiner*—Harry N. Haroian
*Attorney, Agent, or Firm*—Donald A. Bergquist

[57] ABSTRACT

A trammel-beam ellipsograph is disclosed wherein the beam is made of two sliding elements in parallel relationship with a scribe-bearing cursor riding upon them. Each beam element is pivotably attached at one end to a slide restrained within one of two perpendicular tracks. A scale on each beam element indicates the distance from the pivot relating to each respective slide to the scribe on the cursor, thereby indicating a measure of the major and minor axes of the ellipse to be scribed. Concentric ellipses having a uniform elliptical annulus therebetween may be drawn by holding the beam elements against sliding while moving the cursor a distance equal to the width of the annulus. The invention further features modular track sections to facilitate drawing ellipses of aspect ratios greater than 2:1. A trammel-beam ellipsograph is disclosed wherein the beam is made of two sliding elements in parallel relationship with a scribe-bearing cursor riding upon them. Each beam element is pivotably attached at one end to a slide restrained within one of two perpendicular tracks. A scale on each beam element indicates the distance from the pivot relating to each respective slide to the scribe on the cursor, thereby indicating a measure of the major and minor axes of the ellipse to be scribed. Concentric ellipses having a uniform elliptical annulus therebetween may be drawn by holding the beam elements against sliding while moving the cursor a distance equal to the width of the annulus. The invention further features modular track sections to facilitate drawing ellipses of aspect ratios greater than 2:1.

4 Claims, 3 Drawing Sheets

ELLIPSOGRAPH

INTRODUCTION

The craftsman working in a home workshop in his basement, his garage, his barn, or in his professional environment needs a simple, inexpensive, and accurate tool for those occasions when he needs to create an elliptical shape. Although a vast number of ellipsographs have been devised over the years, applicant finds them wanting as being overly complex and expensive.

The basic principle used in the vast majority of ellipsographs is that of a trammel beam pivotably mounted at one point on each of two spaced apart slides that are restricted to move reciprocatingly in mutually perpendicular linear directions; a scribe mounted on said trammel beam, aligned with the pivot points, describes a true ellipse as the slides reciprocate through a full cycle of their motions.

The trammel beam may be a rigid body, an extensible rigid body, or it may be considered a virtual body, wherein various moving parts maintain the spacing between points equivalent to the two pivots and the scribe, thereby producing a result equivalent to that of a rigid trammel beam while those virtual pivot points reciprocatingly traverse their paths along mutually perpendicular axes. The ingenuity shown has each said beam element bearing a scale comprising indicia indicating distance from each respective said pivotable connection, been impressive, but the results produced are confusing to the average craftsman, and especially so to the non-professional or hobbyist, as well as being not economically practical for those craftsmen who have only occasional need for an ellipsograph. Such a craftsman needs an ellipsograph of a nature wherein the adjustments to scribe ellipses of various sizes and aspect ratios are simple to make and intuitively clear and obvious in their effects on the ellipse produced.

PRIOR ART

Trammel beam type ellipsographs may be classified in two broad classifications: the suspended (or overhead) trammel beam, and the contact trammel. Patents relating to ellipsographs of both types are found in the U.S. Patent Office Classification System in subclass 33/31 (GEOMETRICAL INSTRUMENTS/-SCRIBER/Curved line/Ellipsograph/Right-angle guides), which subclass was searched by applicant.

In ellipsographs of the former design, the ellipsograph is suspended above the workpiece to be scribed, by means of a bridge or a cantilever framework. This provides a clear workspace beneath the framework for the trammel beam and the scibe to move; there is no contact at the center of (or even within) the ellipse being scribed. Indeed, using this type of ellipsograph may create a problem in accurately locating the center of the ellipse and in locating the ellipse on a specific center.

While there are advantages to ellipsographs of the suspended variety, one can easily see that the bridge suspending the trammel beam must either span the ellipse (as in U.S. Pat. No. 873,291, Beck, 1907, for instance) or the cantilever must reach to a point above the center of the ellipse (as in U.S. Pat. No. 22,347, Chormann, 1858). For small ellipses, these ellipsographs are adequate. For very large ellipses, however, such as an elliptical full-length mirror or a door with an elliptical glass mounted therein, such ellipsographs would be large, expensive, and likely not available to the craftsman whose need for an ellipsograph of any kind is only occasional. We shall not further consider ellipsographs of the suspended variety as suitable for the craftsman for whom the present invention is intended.

The present invention relates to what we have termed a contact trammel beam ellipsograph. By this terminology, we intend to describe an ellipsograph wherein the trammel beam travels along paths prescribed by apparatus that makes contact with either the workpiece or its substrate and within the ellipse being scribed.

The ellipsograph of U.S. Pat. No. 246,174, McComb, 1881 is typical of what we are calling a contact trammel beam ellipsograph. Others include the following:

U.S. Pat. No. 873,291, Beck, 1907
U.S. Pat. No. 1,021,583, Dzierwa, 1912
U.S. Pat. No. 1,048,126, Ball, 1912
U.S. Pat. No. 1,031,780, Fine, 1912
U.S. Pat. No. 2,452,484, Noble, 1948
U.S. Pat. No. 2,925,655, DeBeek, 1960
U.S. Pat. No. 2,996,804, Hancox, 1961
U.S. Pat. No. 3,562,915, Brown, 1971
U.S. Pat. No. 4,148,144, Stiles, 1979

Whereas the present invention includes scales by which the dimensions of the ellipse to be scribed may be easily and accurately set, reference must be made to patents describing ellipsographs of the suspended variety wherein scales for a similar use are present. These patents include:

U.S. Pat. No. 517,522, King, 1894
U.S. Pat. No. 648,170, King, 1900
U.S. Pat. No. 910,129, Hanson, 1909
U.S. Pat. No. 1,031,780, Fine, 1912
U.S. Pat. No. 2,039,584, Dixon, 1936
U.S. Pat. No. 2,790,240, Silverstein, 1957

In each case wherein scales are present on a trammel beam (in both of the above patent lists), the user must set one pivot point at a mark corresponding to the length of one axis of the ellipse and the other pivot point at a mark corresponding to the difference between the length of the major axis and the length of the minor axis of the ellipse to be scribed. Applicant believes setting these parameters are not intuitive and are difficult for the novice craftsman to understand and to accomplish correctly and accurately. The sole exceptions to this procedure for setting dimensions of the ellipse to be drawn is taught by Noble and by Hancox, wherein the scribe is at the zero point of the scale and the pivots are set at points on the scale corresponding to the length of the major axis and the length of the minor axis respectively. This is a much more easily understood and more intuitively satisfying adjustment, but it does not accomplish all that is accomplished by the present invention.

The combining of Hancox with Noble is considered by applicant to represent the prior art closest to the present invention. Specifically, Hancox provides means to draw concentric ellipses by fixing the distance between guide members 33 and 34 by using a spacer rod 49 clamped by screws to said guide members. He provides two scales, labeled Scale A and Scale B; the former scale is fixed and the latter scale is interchangeable for scales related to other viewing angles. Whereas the Hancox apparatus allows for setting, using Scale A only, both the length of the minor axis and the length of the major axis of the ellipse to be drawn, the aforesaid spacer rod is required for easily drawing concentric ellipses. Both Hancox and Noble provide for disassembly of the tracks on which the trammel pivots ride; Noble addresses the longitudinal repositioning or temporary removal of at least one track to provide for drawing ellipses of dimensions smaller than those permitted by the length of the tracks, while Hancox avoids the problems associated with drawing ellipses of such small dimensions by drawing only one half of the ellipse and then repositioning the ellipsograph to draw the other half. The disassembly taught in the Hancox patent is merely for convenience in storing the apparatus. In another relevant patent, the Dzierwa patent teaches tracks that collapse for storage, but says that during use, "the pencil will travel around on the paper or board between its arms and must be lifted over them as they are encountered." In contrast, the present invention provides for the removal of modular segments of the arms, thereby to allow the scribe to make a continuous mark. These patents will be discussed as specific features of this invention are described.

SUMMARY OF THE INVENTION

It is an object of this invention to provide a contact type trammel beam ellipsograph having linear scales on the trammel beam thereof that provide a simplified way of setting the length of the major axis and length of the minor axis of the ellipse to be scribed.

It is an object of this invention to provide a contact type trammel beam ellipsograph having detatchable modular rails in which the trammel beam pivots travel, therby to provide for scribing ellipses of both small and large dimensions with the same basic apparatus.

It is an object of this invention to provide a contact type trammel beam ellipsograph having detatchable modular rails in which the trammel beam pivots travel, thereby to provide for scribing ellipses having aspect ratios (i.e., major axis: minor axis) that are greater than 2:1.

It is an object of this invention to provide a contact type trammel beam ellipsograph having detatchable modular rails in which the trammel beam pivots travel, thereby to provide for ease of transport and storage of the apparatus.

It is an object of this invention to provide a trammel beam ellipsograph having slidably adjustable scales whereby the dimensions of the ellipse to be drawn may be conveniently set in an intuitively satisfying manner.

It is an object of this invention to provide a trammel beam ellipsograph having slidably adjustable scales whereby the dimensions of the ellipse to be drawn may be conveniently set and concentric ellipses (i.e. ellipses having therebetween a uniform elliptical annulus) may be drawn.

It is an object of this invention to provide a trammel beam ellipsograph having slidably adjustable scales whereby the dimensions of the ellipse to be drawn may be conveniently set and concentric ellipses (i.e. ellipses having therebetween a uniform elliptical annulus) may be drawn and wherein the settings to draw such ellipses may be conveniently set in an intuitively saisfying manner.

DETAILED DESCRIPTION OF THE INVENTION

This invention will best be understood by referring to the accompanying figures, in which for each part identified therein the same reference number is used to identify that part throughout.

Figure 1:
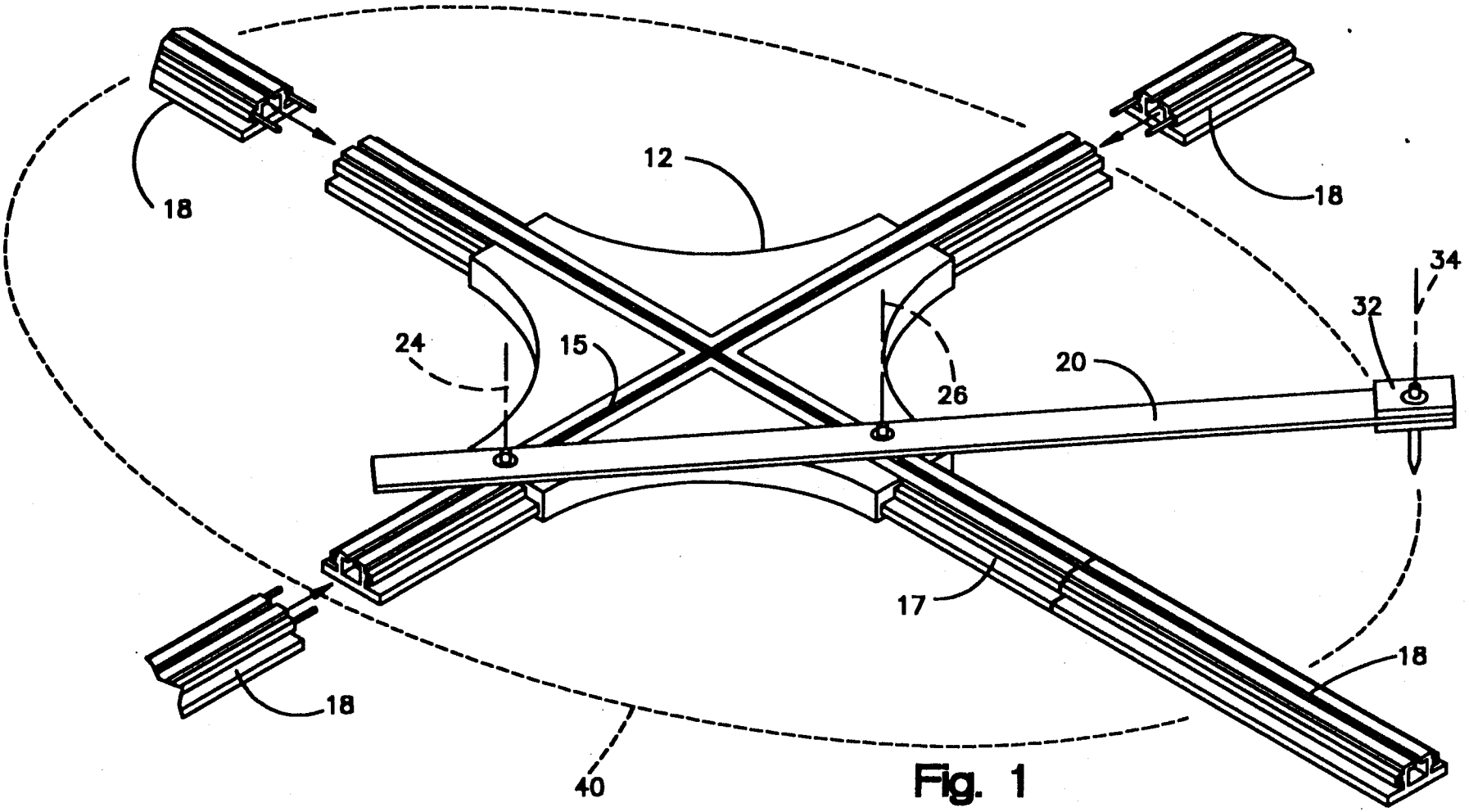
FIG. 1 shows the ellipsograph of the present invention.

The basic function of trammel beams, like that of the present invention, is shown in FIG. 1, which figure illustrates largely, but not wholly, prior art. The ellipsograph 10 is made up of a base 12 on which are positioned two mutually perpendicular tracks in each of which is held, in slidable restraint, a slide. As can be seen in this figure, a first slide 14 is restrained by a first track 15 to move along said first track only, while a second slide 16 is restrained by a second track 17 to move along said second track only. Said first track 15 and said second track are straight and mutually perpendicular. A feature of this invention is that the tracks are segmented (in other words, modular), as is shown by additional segments 18, thereby to permit addition of plural modules to extend the length of either track or of both tracks. This feature permits, among other things, the scribing of smaller or larger ellipses with the same apparatus while providing for easy transporting and storage of the disassembled ellipsograph. Additional features of this invention will be later described.

A trammel beam 20 is provided that pivotably attaches at one end thereof to said first slide 14. At a medial location along beam 20 is a second attachment means is provided to pivotably attach the beam 20 to said second slide 16. Elsewhere along the beam, a scribe attachment means 32 adapted to hold a scribing means 34 is mounted. In practice, the scribing means 34 could be a sharp instrument for scratching a surface to be scribed, a pencil, pen, or other marker for leaving a mark on a surface, or a blade or other instrument for cutting a workpiece the scribing means encounters.

It has long been known that an apparatus constructed as described and shown will produce an elliptical motion at the scribing means 34 while the beam 20 is swept through the range of motion possible within the restrictions imposed by the slides 14, 16 moving within their respective tracks 15, 17. It is further well known that the major and minor dimensions of the ellipse 40 thus scribed are a direct function of the relative positions along the beam 20 of the pivot axis 24 related to the first slide 14, the pivot axis 26 related to the second slide 16, and the scribing means 34. The length of the major axis 42 of the ellipse 40 is exactly twice the distance from the pivot axis 24 related to the first slide 14 to the scribing means 34. The length of the minor axis 44 of the ellipse 40 is exactly twice the distance from the pivot axis 26 related to the second slide 16 to the scribing means 34. Further, the center of the ellipse 40 is at the point where the path of the first pivot axis 24 crosses the path of the second pivot axis 26, the minor axis 44 of the ellipse 40 will be aligned with said first track 15, and the major axis 42 of the ellipse 40 will be aligned with said second track 17. In practice, provision is made by using notches, holes, or scribe marks to ensure alignment of the apparatus with the pair of crossed lines customarily drawn on the workpiece to accurately locate the ellipse that is to be scribed thereon.

The features of this invention are related not to the function of the trammel beam in scribing an ellipse, but in the trammel beam itself, in that the trammel beam in the ellipsograph of this invention is a compound beam, comprising two slidably joined beams, each having a scale associated therewith.

Figure 2:
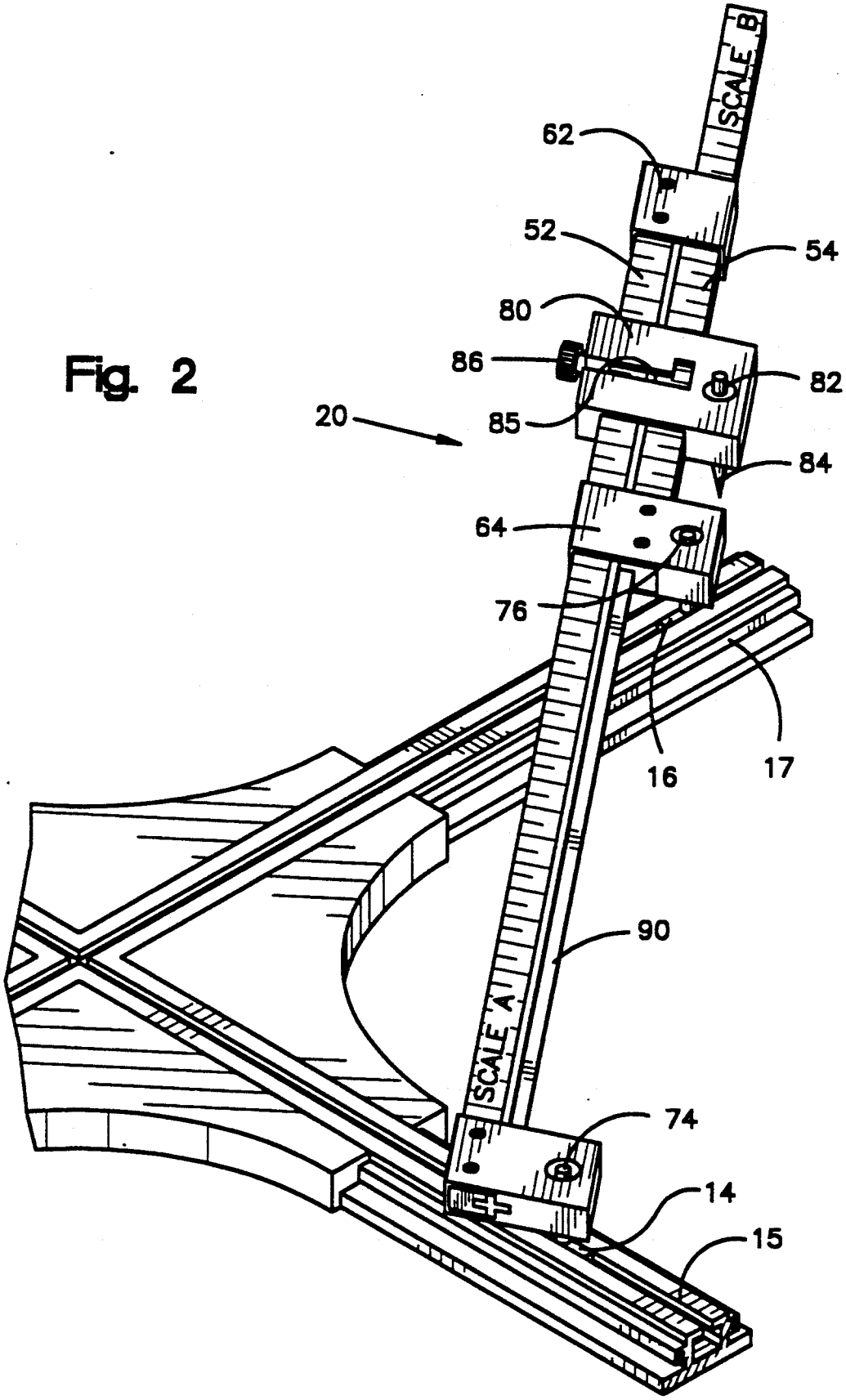
FIG. 2 shows details of the trammel beam of the ellipsograph of the present invention.

The trammel beam of this invention is shown in FIG. 2. The trammel beam 20 comprises two beams 52 and 54 that are slidably joined. The method of joining shown, while not limiting the invention, comprises a first joining element 62 fixedly attached to the first beam 52, preferably at one end thereof, and slidably attached to the second beam 54 and a second joining element 64 fixedly attached at an end of the second beam 54 and slidably attached to the first beam 52.

At one end of the first beam 52 is fixedly mounted a first pivot means 74 to pivotally attach this beam to a first slide 14 engaged in the first track 15. The second joining element 64 also includes a pivot means hereinafter referred to as the second pivot means 76 to pivotally attach this element to a second slide 16 engaged in the second track 17. A cursor 80 with an associated scribe holding means 82 for holding a scibing, cutting, or writing tool 84 is slidably mounted on the trammel beam between the first joining element 62 and the second joining element 64. The scribing tool 84, the first pivot 74, and the second pivot 76 are always maintained in linear alignment.

Along the length of the first beam 52 is affixed a scale, Scale A, whereon is indicated a measure of the linear distance along the first beam 52 from the first pivot point 74 to the scribing means 84 attached to the cursor 80. Similarly, along the length of the second beam 54 is affixed a scale, Scale B, whereon is indicated a measure of the linear distance along the second beam 54 from the second pivot point 76 to the scribing means 84 attached to the cursor 80. Thus Scale A and Scale B indicate respectively the major and minor axes of the ellipse being drawn. In the preferred mode, the cursor 80 has an indicating means or edge 85 as a part thereof, which indicating means precisely indicates the position of the cursor 80, and especially the position of the sribing means 84 thereon, relative to the scale, Scale A and Scale B.

The user may easily set the apparatus to the dimensions of the ellipse to be scribed by holding the indicating means 85 (on the cursor 80) at the mark on Scale A corresponding to the length of the major axis of the ellipse to be scribed while sliding the second beam 54 to position the mark on Scale B corresponding to the length of the minor axis of the ellipse to be scribed. A locking means, such as the setscrew 86, on the cursor 80 is then used to immobilize the cursor 80 and the two beams 52 and 54 while the ellipse is scribed in the normal fashion.

In the best mode, the first beam 52 and the second beam 54 are joined with a spline 90 therebetween to provide lateral alignment of the two portions of the trammel beam along the length thereof. Such construction is to be preferred over the alternative of providing a tongue on one beam and a groove in the other. In such construction, should the tongue be broken, the entire beam would need replacing. Were the spline 90 to be damaged, it could easily be removed and replaced at minimal cost and effort.

Figure 3:
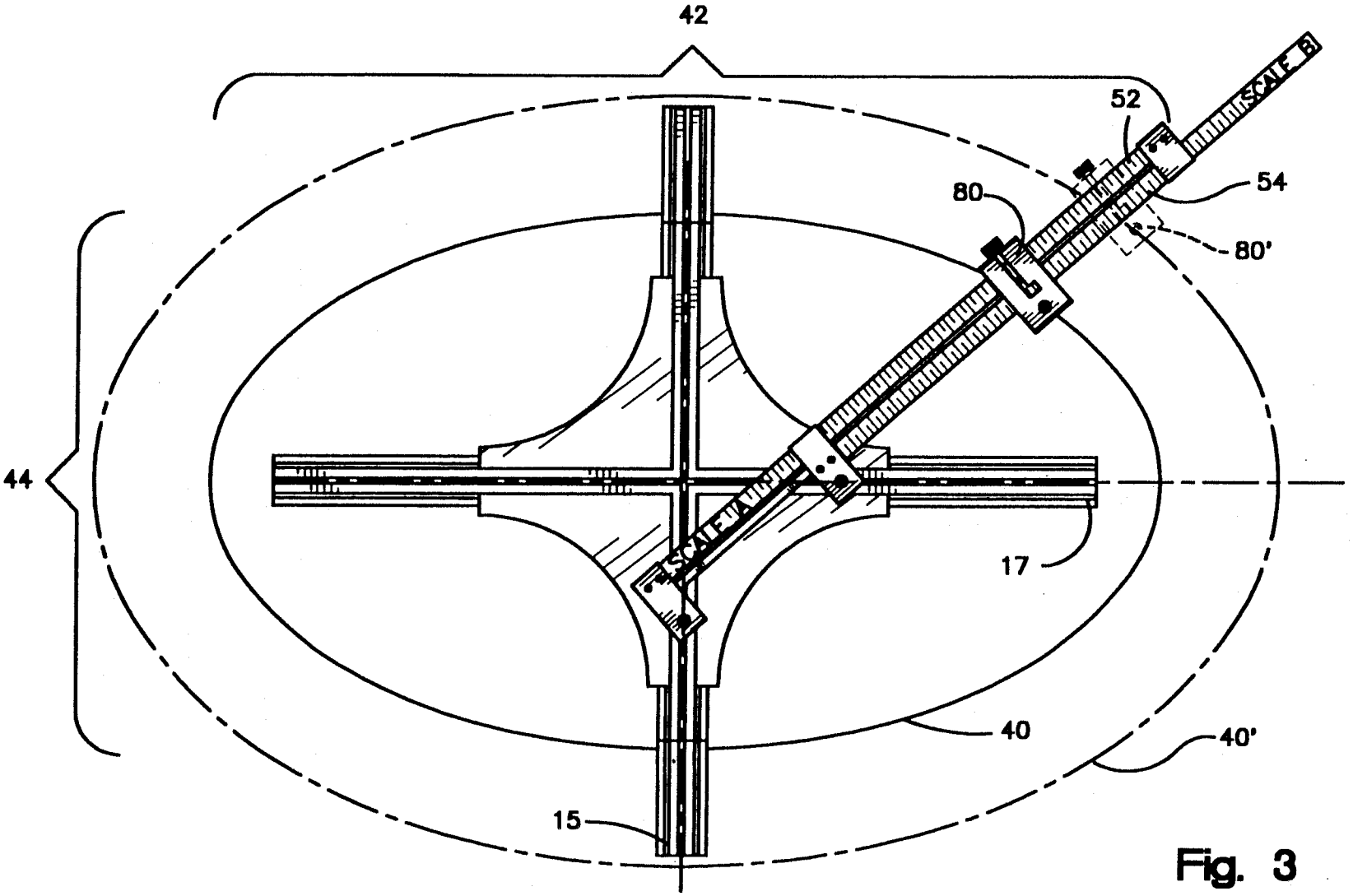
FIG. 3 shows details of how the scribe may be adjusted on the trammel beam of the present invention to scribe concentric ellipses.

The ease with which concentric ellipses may be drawn by using the present invention is illustrated in FIG. 3. The first ellipse 40 is drawn in the aforesaid manner. Now, to draw an ellipse 40' concentric to the first, that is having an elliptical anulus of constant width relative to the first ellipse, it is an elegantly simple, obvious, and intuitively satisfying adjustment to hold the two beams 52 and 54 immobile with respect to each other while repositioning the cursor 80, and particularly the indicating means 85, to either the mark on Scale A corresponding to the length of the major axis of the new allipse or the mark on Scale B corresponding to the length of the minor axis of the new ellipse, as is indicated as 80'. Similarly, if an elliptical annulus of a two-inch width is required, as for an elliptical picture frame, it becomes an easy matter to move the cursor 80 along the trammel beam 20 two inches from its initial position while holding the two beams 52 and 54 immobile; this is, indeed, a most intuitively satisfying adjustment and one that is neither taught nor suggested in any of the prior art ellipsographs.

It should be noted that Scale A and Scale B may be marked in a standard linear scale (in inches or centimeters, for example), thereby to directly indicate one-half the lengths of the major axis and minor axis, respectively, of the ellipse to be drawn. Such standard markings would especially facilitate the described method of drawing an elliptical annulus (i.e., by moving the cursor the true, not half-scale, distance equal to the desired width of the annulus). Alternatively, Scale A and Scale B may be marked in half-scale by markings that would thereby indicate directly the respective lengths of the major axis and minor axis of the ellipse to be drawn, which may be more convenient to some craftsmen. Thus, both of these considerations are within the scope of the teachings of this disclosure.

In making an improvement to the trammel beam, applicant found deficiencies in the prior art as it pertains to the tracks along which the slides move. In this regard, the improvement here presented is most closely related to the patent issued to Hancox. Whereas Hancox teaches the temporary removal of entire tracks to provide for drawing ellipses wherein the tracks interfere with the passage of the scribing means, which problem arises while drawing ellipses of aspect ratios greater than 2:1, the present invention teaches the use of multiple identical track segments 18 from which track is assembled in modular fashion, as is shown in FIG. 1. Thus, where a track interferes with the scribing means in its motion around the ellipse, only those interfering segments need to be removed, rather than removing the entire length of track as is taught by Hancox. This feature is especially important while scribing high aspect ratio ellipses of larger sizes, wherein removal of the entire track may be cumbersome.

The modular track also provides the advantage of providing apparatus for scribing large ellipses while keeping the size of the apparatus manageable for storage and transport thereof.

Now, having presented description and specific examples of my invention by way of explanation so one skilled in this art may reproduce the product of my invention, it should be understood that the invention has greater breadth than one can delineate in a few specific examples. It is my wish and intention to incude in my invention the extent of the art that may be immediately obvious from my descriptions and examples; such breadth is included in the claims attached hereto.

I claim:

1. A trammel beam ellipsograph comprising:

a first slide slidably engaging a first track and a second slide slidably engaging a second track, said first and second tracks being mutually perpendicular and each said track comprising two separate track sections extending in opposite directions from a central point at which said tracks cross;

a beam comprising a first beam element slidably joined to a second beam element in a parallel relationship thereto, said first beam element having, preferably at one end thereof, a first pivotable connection connecting it to said first slide, said second beam element having, preferably at one end thereof, a second pivotable connection connecting it to said second slide, said first beam element bearing a scale comprising indicia indicating distance from said first pivotable connection and said second beam element bearing a scale comprising indicia indicating distance from said second pivotable connection;

and a cursor riding on said two beam elements along said two scales and carrying a scribing means in linear alignment with said two pivotable connections, whereby the ellipsograph so described may be quickly and accurately set to scribe an ellipse of desired dimensions by setting the cursor to said desired dimensions, said dimensions being directly proportional to the lengths of the major axis and the minor axis of said ellipse, as indicated by said indicia on said first and second scales, and said ellipsograph may then be used to scribe said ellipse in the usual manner.

2. The ellipsograph of claim 1 wherein said track sections are each modular in construction, each said track section thereof comprising multiple identical modular segments so to extend the effective length of each said track section, thereby providing for the removal of one or more modular segments, but not the entire track section, to permit the passage of said scribe while scribing said ellipse.

3. The ellipsograph of claim 1 wherein said first beam element is slidably joined to said second beam element with a spline interposed therebetween to provide lateral stability between the said beam elements.

4. The ellipsograph of claim 2 wherein said first and second tracks comprise a central hub element comprising a base for the crossing of the said two tracks, thus providing a base to which said modular segments may be connected to form each of the said track sections.

* * * * *